US010619111B2

(12) United States Patent
Hao et al.

(10) Patent No.: US 10,619,111 B2
(45) Date of Patent: Apr. 14, 2020

(54) CATALYTIC GASOLINE DESULFURIZATION METHOD HAVING ALSO AN OLEFIN SELECTIVE REMOVAL FUNCTION

(71) Applicant: HEBEI REFINING TECHNOLOGY CO., LTD., Cangzhou, Hebei (CN)

(72) Inventors: Tianzhen Hao, Hebei (CN); Xuhui Gao, Hebei (CN)

(73) Assignee: HEBEI REFINING TECHNOLOGY CO., LTD., Cangzhou, Hebei (CN)

( * ) Notice: Subject to any disclaimer, the term of this patent is extended or adjusted under 35 U.S.C. 154(b) by 0 days.

(21) Appl. No.: 16/343,679

(22) PCT Filed: May 16, 2017

(86) PCT No.: PCT/CN2017/084460

§ 371 (c)(1),
(2) Date: Apr. 19, 2019

(87) PCT Pub. No.: WO2018/090584

PCT Pub. Date: May 24, 2018

(65) Prior Publication Data

US 2019/0241821 A1 Aug. 8, 2019

(30) Foreign Application Priority Data

Nov. 16, 2016 (CN) ..... 2016 1 1018478

(51) Int. Cl.

| | |
|---|---|
| ***C10G 21/00*** | (2006.01) |
| ***C10G 67/16*** | (2006.01) |
| ***C10G 45/38*** | (2006.01) |
| ***C10G 7/06*** | (2006.01) |
| ***C10G 45/02*** | (2006.01) |
| ***C10G 67/00*** | (2006.01) |

(52) U.S. Cl.

CPC ..... *C10G 67/16* (2013.01); *C10G 7/06* (2013.01); *C10G 45/02* (2013.01); *C10G 45/38* (2013.01); *C10G 67/00* (2013.01); *C10G 2300/104* (2013.01); *C10G 2300/1044* (2013.01); *C10G 2300/202* (2013.01); *C10G 2300/4006* (2013.01); *C10G 2300/4012* (2013.01); *C10G 2300/4081* (2013.01); *C10G 2400/02* (2013.01)

(58) Field of Classification Search

CPC ..... C10G 21/00

See application file for complete search history.

(56) References Cited

U.S. PATENT DOCUMENTS 5,360,532 A * 11/1994 Fletcher ..... C10G 67/04 208/211
6,551,502 B1 * 4/2003 Lee ..... C10G 67/04 203/53

FOREIGN PATENT DOCUMENTS

| | | | |
|---|---|---|---|
| CN | 101100616 | A | 1/2008 |
| CN | 101492608 | A | 7/2009 |
| CN | 103555359 | A | 2/2014 |
| CN | 105238441 | A | 1/2016 |
| CN | 105255515 | A | 1/2016 |
| CN | 105296000 | A | 2/2016 |
| CN | 106520198 | A | 3/2017 |

OTHER PUBLICATIONS

International Search Report and Written Opinion, International Patent Application No. PCT/CN2017/084460 with English translation (17 pages).

* cited by examiner

*Primary Examiner* — Randy Boyer
(74) *Attorney, Agent, or Firm* — Hamre, Schumann, Mueller & Larson, P.C.

(57) ABSTRACT

The present invention provides a catalytic gasoline desulfurization method having also an olefin selective removal function, which comprises: when a catalytic gasoline is pre-hydrotreated, cutting into a light fraction, a middle fraction and a heavy fraction; performing liquid-liquid extraction desulfurization treatment on the middle fraction to produce a sulfur-poor oil and a rich solvent containing sulfur-rich oil; the light fraction back-extracting the rich solvent, using C5 olefin therein to replace a macromolecular acyclic olefin in the sulfur-rich oil, so as to gather together C5 iso-olefins, cycloolefins, aromatic hydrocarbons and sulfides in the sulfur-rich oil; performing hydrogenation, olefin-reduction and desulfurization treatment on the heavy fraction together with the sulfur-rich oil removed from the back-extracted rich solvent to saturate the olefin therein; and finally, preparing together with the sulfur-poor oil to produce a full range gasoline. The sulfur-content of the catalytic gasoline produced by the method of the present invention can be reduced to 10 ppm or less, the olefin content of the catalytic gasoline can be reduced to 22%, the olefin is saturated by up to 8 percentage, and the RON loss of the full range gasoline is 1.5 or less, so that while reducing the olefin content of the catalytic gasoline, it ensures the less octane number loss, thereby satisfying the olefin-reduction requirements upgraded in the gasoline National VI Standard for ethanol-gasoline supply area enterprises.

9 Claims, 1 Drawing Sheet

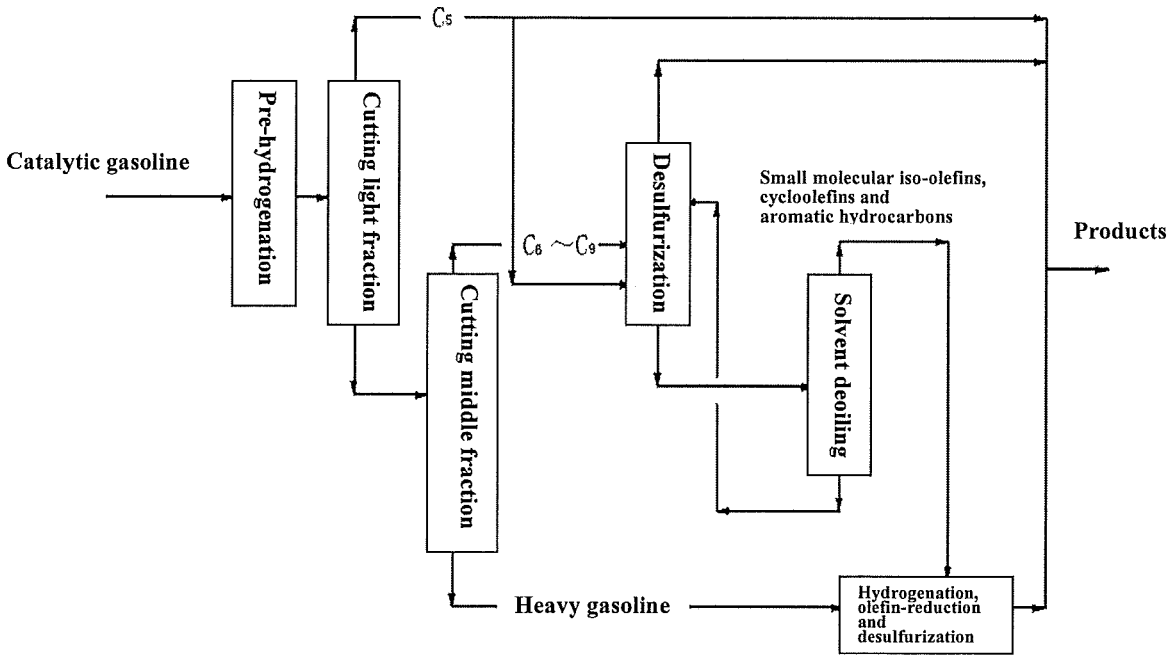
Catalytic gasoline
Pre-hydrogenation
Cutting light fraction
C5
Cutting middle fraction
C6 ~C9
Desulfurization
Small molecular iso-olefins, cycloolefins and aromatic hydrocarbons
Solvent deoiling
Products
Heavy gasoline
Hydrogenation, olefin-reduction and desulfurization

CATALYTIC GASOLINE DESULFURIZATION METHOD HAVING ALSO AN OLEFIN SELECTIVE REMOVAL FUNCTION

TECHNICAL FIELD

The present invention belongs to the petrochemical field, and specifically relates to a catalytic gasoline desulfurization method.

BACKGROUND ART

Automobiles have become an indispensable element in modern human life, and the air pollution caused by their emissions has become increasingly serious, and directly threatens human health. Therefore, solving the problem of environmental pollution of motor vehicles has become a major task at present. Gasoline quality upgrade is one of the important methods to reduce motor vehicle emissions.

The difficulty in upgrading gasoline quality is not only to reduce the content of sulfur and olefin, but also to ensure the low loss of octane number and high yield of gasoline. Sulfur and olefins in gasoline are almost entirely derived from the catalytic gasoline, therefore, reducing the sulfur and olefin content of catalytic gasoline and ensuring low loss of octane number and high yield become the difficulties in upgrading gasoline quality. In the gasoline quality upgrade of the National VI Standard, reducing olefin while preserving octane number of gasoline become the focus of attention of human. The gasoline standards of National V Standard and National VI Standard are shown in Table 1 below. (Note: The National VI Standard is a proposed scheme at present, two schemes have been proposed, and the specific scheme has yet to be determined).

TABLE 1

Comparison of gasoline standards of National V Standard and National VI Standard

| | Gasoline standard | | | |
|---|---|---|---|---|
| | National V Standard | National VI A Standard | National VI B Standard | The variation of National VI Standard comparing to National V Standard |
| Sulfur content, mg/kg, no greater than | 10 | 10 | 10 | |
| Benzene content, % (V), no greater than | 1 | 0.8 | 0.8 | reducing by 0.2 percentage |
| Aromatic hydrocarbon content, % (V), no greater than | 40 | 35 | 35 | reducing by 5 percentage |
| Olefin content, % (V), no greater than | 24 | 18 | 15 | reducing by 6-9 percentage |
| Oxygen content, % (m), no greater than | 2.7 | 2.7 | 2.7 | |
| Methanol content, % (m), no greater than | 0.3 | 0.3 | 0.3 | |

China is a big country in catalytic cracking, and catalytic gasoline accounts for 70% in the gasoline pool. In order to meet the requirement of upgrading quality and reducing olefins in the gasoline National VI Standard, the proportion of the compositions free of olefin such as reformate, aromatic oil, alkylated oil, isomerized oil and so on in the gasoline pool will increase in the next few years, and it is optimistically estimate that the proportion of the catalytic gasoline will be reduced to 60%. In addition, the olefin content in the catalytic gasoline can be reduced from 40% to about 30% by applying olefin-reduction technologies on a catalytic apparatus, for example, by applying technologies such as MT process, an olefin-reduction catalyst, LTAG and the like on the catalytic apparatus.

After adopting the above two means, it requires that the olefin content in the catalytic gasoline with an olefin content of 30% should be further reduced by 6-8 percentage (that is, the olefin content should be reduced to 22% or less) during refining process in order to meet the National VI factory standard of olefins. If the requirement for the olefin content is satisfied by simply increasing the depth of hydrogenation, the loss of octane number will be unbearable.

In the prior art, a Chinese patent ZL201310581366.8 applied by Hebei Refining Technologies Company Limited discloses a catalytic gasoline desulfurization technology for selectively preventing olefins from large loss of octane number. The technology cuts the catalytic gasoline into three fractions of a light, medium and heavy fraction. Among them, the olefin content in the light fraction is the highest, and the sulfur content of the fraction can be 10 ppm or less only by cutting after performing pre-hydrogenation treatment on the catalytic gasoline (<40° C., mainly C5). As for the middle fraction (40-100° C., mainly C6-C7), it mainly adopts a liquid-liquid extraction and separation means to obtain sulfur-poor oil mainly composed of alkenes and sulfur-rich oil mainly composed of aromatic hydrocarbons and sulfides, and to reduce the sulfur content in the sulfur-poor oil to 10 ppm or less. The sulfur-rich oil is mixed with the heavy fraction (>100° C.), and then selectively hydrotreated to achieve a sulfur content of 10 ppm or less. In the method, the middle fraction is subjected to liquid-liquid extraction and desulfurization. The middle fraction is fed from the middle of the extraction tower, and a desulfurization solvent is injected from the top of the extraction tower. After multi-stage countercurrent contact, due to the over-dissolution of the solvent and relatively larger dissolved amount of the olefin therein, the saturated C5 enters from the bottom of the extraction tower, and is in fully contact with the desulfurization solvent dissolved with the olefins in the lower part of the tower, so as to displace the olefins therein, reduce the dissolution of the olefins in the solvent, and minimize the olefin content in the sulfur-rich oil.

The technology described above achieves the goal of the desulfurization and preserving octane number upgraded in the gasoline National V Standard, and shows excellent application effects in practice. However, in order to meet the requirements of the new National VI Standard for further reducing olefins, it is necessary to further propose a catalytic gasoline desulfurization method which can ensure preserving the loss of the octane number of the catalytic gasoline at the level of the National V Standard and further reduce the olefin.

CONTENTS OF THE INVENTION

In view of the above cases, the purpose of the present invention is to provide a catalytic gasoline desulfurization method having also an olefin selective removal function. The technology ensures that the loss of the octane number can be preserved at the level of National V Standard, while meets the requirements of National VI Standard for further reducing the olefin.

The purpose of the present invention stated above is achieved by the following technical solution:

Provided is a method for desulfurizing the catalytic gasoline comprising the following steps:

1) Pre-hydrotreating a catalytic gasoline, and cutting it into a light fraction having a sulfur content of less than 10 ppm and mainly composed of a C5 fraction, a middle fraction mainly composed of a C6-C9 fraction, and a heavy fraction.

2) Performing liquid-liquid extraction desulfurization treatment on the middle fraction obtained in the step 1) using a desulfurization solvent, to produce a sulfur-poor oil with a sulfur content of less than 10 ppm and a sulfur-rich oil in which macromolecular acyclic olefins, aromatic hydrocarbons and sulfides dissolved in the desulfurization solvent;

3) Back-extracting the rich solvent obtained in the step 2) using part of or all the light fraction obtained in the step 1), that is, using C5 olefin in the light fraction to replace a macromolecular acyclic olefin in the sulfur-rich oil, so as to dissolve the C5 iso-olefins, cycloolefins, aromatic hydrocarbon and sulfides in the rich solvent together;

and;

performing hydrogenation, olefin-reduction and desulfurization treatment on the heavy fraction together with the sulfur-rich oil removed from the back-extracted rich solvent to saturate the olefin therein; and finally, preparing together with the sulfur-poor oil to produce a full range gasoline 4) Separating the sulfur-rich oil from the back-extracted rich solvent in the step 3), then performing hydrogenation, olefin-reduction and desulfurization treatment on the heavy fraction obtained in step 1) together with the sulfur-rich oil so as to reduce the sulfur-content to less than 10 ppm and to make the olefin be saturated as more as possible; and finally, preparing together with the reminder of the light fraction obtained in the step 1) and the sulfur-poor oil obtained in the step 2) to produce a full range gasoline.

In the solution of the present invention, the pre-hydrotreating described in the step 1) can hydroconvert the diolefin, so as to avoid coking in the subsequent process; at the same time, the small-molecule sulfur is converted into the macromolecular sulfur, so that the sulfur in the light gasoline enters the heavier fraction. The hydrogenation condition in the step need to be relatively moderate. The present invention preferably adopts liquid phase hydrogenation using cobalt molybdenum as an active catalyst, the operating pressure is 1.0-3.0 MPa, the temperature is 100-200° C., the hydrogen-oil ratio is 3-10, and the space velocity is 1-3 $h^{-1}$.

In a preferred embodiment of the invention, as for the cutting described in the step 1), said light fraction is preferably cut at a cutting point of 30-50° C., and said middle fraction is cut at a cutting point of 130-160° C.

In a preferred embodiment of the present invention, performing the liquid-liquid extraction desulfurization treatment on the middle fraction using a desulfurization solvent described in the step 2) is performed in a extracting desulfurization tower. Said middle fraction is fed from the middle of the tower, and said desulfurization solvent is injected from the top of the tower. The temperature at the top of the tower is controlled to be 85-150° C., the temperature at the bottom of the control tower is controlled to be 70-120° C., the pressure (absolute pressure) at the top of the tower is controlled to be 0.2-0.7 MPa, and the feed ratio of the desulfurization solvent to the middle fraction is controlled to be 1.0-5.0. Said middle fraction is in multi-stage countercurrent contact with the desulfurization solvent in the upper part of the tower, and the sulfur-poor oil with a sulfur-content of 10 ppm or less obtained at the top of the tower is washed with water for recovering the solvent, and then sent to the gasoline pool as a blending component for a reserve.

In a further preferred embodiment of the present invention, the back-extracting described in the step 3) is also carried out in said extracting desulfurization tower, said light fraction is fed from the lower part of the extracting desulfurization tower, and the feed ratio of the light fraction to the middle fraction is controlled to be 0.1-0.5.

In a further preferred embodiment of the present invention, separating the sulfur-rich oil from the rich solvent described in the step 4) is carried out in a deoiling tower, the pressure (absolute pressure) at the top of the tower is controlled to be 0.015 to 0.07 MPa, and the temperature at the bottom of the tower is controlled to be 130-175° C. After vacuuming distillation and stripping distillation, the separated sulfur-rich oil is distilled from the top of the tower and sent to a hydrogenation apparatus for desulfurizing and reducing olefin, and the desulfurization solvent after being deoiled is extracted from the bottom of the tower and then return into the top of said extracting desulfurization tower for recycling use.

In the solution of the present invention, as for the hydrogenation, olefin-reduction and desulfurization treatment process described in the step 4), it requires that the olefin is saturated as more as possible, and the sulfur is substantially removed, but the structural destruction of the aromatic hydrocarbon during the hydrogenation should be avoided. As for these requirements, the preferred hydrogenation, olefin-reduction and desulfurization treatment in the step 4) of the present invention adopts the catalyst using the metal of nickel, molybdenum and tungsten and/or ions thereof as an active component and activated alumina as a carrier, and the operation conditions are controlled at temperature of 240-320° C., pressure of 1.0-3.0 MPa, a hydrogen-oil ratio of 200-500 and a space velocity of 1-4 $h^{-1}$.

The preferred embodiment of the method for desulfurizing the catalytic gasoline stated in the present invention, as shown in FIG. 1, comprises the following continuous processes:

(1) Pre-hydrotreating the catalytic gasoline: it adopts the liquid phase hydrogenation using cobalt molybdenum as an active catalyst, the operating pressure is 1.0-3.0 MPa, the temperature is 100-200° C., the hydrogen-oil ratio is 3-10, and the space velocity is 1-3 $h^{-1}$.

(2) The pre-hydrotreated catalytic gasoline in the step (1) enters a fractionation tower for cutting the light gasoline, which is named "light fraction cutting tower", the light gasoline mainly composed of the C5 fraction is cut at a cutting point of 40° C., the light gasoline is discharged from the top of the light fraction cutting tower, while the residual fraction is discharged from the bottom of the light fraction cutting tower and enters another fractionation tower for cutting the middle gasoline, which is named "middle fraction cutting tower";

(3) The middle gasoline mainly composed of C6-C9 fractions is cut at a cutting point of 150° C. in the middle fraction cutting tower, the middle gasoline is discharged from the top of the middle fraction cutting tower, and the heavy gasoline is discharged from the bottom of the middle fraction cutting tower;

(4) The middle gasoline discharged from the top of the middle fraction cutting tower in the step (3) enters the middle part of a extracting desulfurization tower, all or part of the light gasoline discharged from the top of the light fraction cutting tower in the step (2) enters the lower part of the extracting desulfurization tower; and the desulfurization solvent is injected from the top of the extracting desulfurization tower.

The operation conditions of the extracting desulfurization tower are that: the temperature at the top of the tower is 85-150° C., the temperature at the bottom of the tower is 70-120° C.; the pressure (absolute pressure) at the top of the tower is 0.2-0.7 MPa; the feed ratio of the desulfurization solvent to the middle gasoline is controlled to be 1.0-5.0; and the feed ratio of the light gasoline to the middle gasoline is controlled to be 0.1-0.5.

The middle gasoline after being desulfurized is sent out from the top of the extracting desulfurization tower, washed with water for recycling the solvent, and then sent to the gasoline pool as a blending component; and the desulfurization solvent concentrated with small molecular iso-olefins, cycloolefins, aromatic hydrocarbons and sulfides is sent into a deoiling tower from the bottom of the extracting desulfurization tower.

(5) In the deoiling tower, the pressure (absolute pressure) at the top of the tower is controlled to be 0.015-0.07 MPa, and the temperature at the bottom of the tower is controlled to be 130-175° C.; the desulfurization solvent is purified by vacuuming distillation and stripping distillation; the sulfur-rich oil is distilled off at the top of the tower; and the extracted and deoiled desulfurization solvent at the bottom of the deoiling tower is returned into the top of the extracting desulfurization tower described in the step (4) for recycling use.

(6) The sulfur-rich oil distilled from the deoiling tower in the step (5) together with the heavy gasoline discharged from the bottom of the middle fraction cutting tower in the step (3) are sent to the hydrogenation apparatus for performing the highly active hydrogenation, in order to make the olefin therein be saturated, and to remove the sulfur to 10 ppm or less, then obtain the desulfurized and olefin-reduced fraction.

(7) The full range gasoline with a sulfur-content of less than 10 ppm and a olefin content of less than 22% is prepared and obtained by the desulfurized and olefin-reduced fraction obtained in the hydrogenation apparatus in the step (6) together with the light gasoline obtained at the top of the light fraction cutting tower in the step (2) and the middle gasoline obtained at the top of the extracting desulfurization tower in the step (4).

In the extraction and desulfurization of the method of the present invention, the C5 fraction is fed into the bottom of the desulfurization tower, the sulfur-rich oil obtained by performing extraction and desulfurization on the middle gasoline is back-extracted with the small molecular olefin in the C5 fraction, in order to replace the higher molecular olefin dissolved in the sulfur-rich oil, so that the sulfur-rich oil is mainly composed with the aromatic hydrocarbons, C5 iso-olefins, cycloolefins and sulfides. In this way, while performing the extraction and desulfurization on the C6-C9 fractions, a selective separation of the olefin is achieved. That is, the cycloolefins with high solubility in the middle gasoline is concentrated in said sulfur-rich oil, the cycloolefins and the C5 iso-olefin with minimum octane number loss after being saturated by hydrogenating is also concentrated in the sulfur-rich oil. Said sulfur-rich oil separated from the solvent (containing the small molecular iso-olefins, cycloolefins, aromatic hydrocarbons and sulfides) together with the heavy gasoline at the bottom of the middle fraction cutting tower are sent to the hydrogenation apparatus for desulfurizing and reducing olefin, and the cycloolefin and the small molecular iso-olefins are saturated as more as possible during the hydrogenation, thereby achieving the purpose of selective reducing-olefin, and making the sulfur-content be 10 ppm or less. On the basis of the process of the present invention, the sulfur-content of the catalytic gasoline can be reduced to 10 ppm or less, the olefin in the catalytic gasoline can be reduced from 30% to 22%, the olefin is saturated by up to 8 percentage, and the RON loss of the full range gasoline is 1.5 or less, so that the requirement for less octane number loss is ensured, while reducing the olefin content of the catalytic gasoline is satisfied.

DESCRIPTION OF THE FIGURES

FIG. 1 is the process flow chart of the preferred embodiment of the present invention.

DETAILED EMBODIMENTS

In order to further illustrate the technical solution of the present invention, the following description is made by the way of giving examples, but the scope of the present invention is not limited to the illustrated examples.

Example 1

A catalytic gasoline desulfurization method having also an olefin selective removal function, the process flow of which is shown as the FIG. 1, specifically comprises the following steps:

(1) Performing the pre-hydrotreatment on the catalytic gasoline: the diene is hydroconverted, and at the same time, the small molecular sulfur is converted to the macromolecule sulfur, so that the sulfur in the light gasoline enters the heavier fraction.

(2) The pre-hydrotreated catalytic gasoline in the step (1) enters the light fraction cutting tower, the light gasoline mainly composed of the C5 fraction is cut at a cutting point of 40° C., the light gasoline is discharged from the top of the light fraction cutting tower, and the residual fraction is discharged from the bottom of the light fraction cutting tower and enters the middle fraction cutting tower.

(3) The middle gasoline mainly composed of C6-C9 fractions is cut at a cutting point of 150° C. in the middle fraction cutting tower, the middle gasoline is discharged from the top of the middle fraction cutting tower, and the heavy gasoline is discharged from the bottom of the middle fraction cutting tower.

(4) The middle gasoline discharged from the top of the middle fraction cutting tower in the step (3) enters the middle part of the extracting desulfurization tower, all the light gasoline discharged from the top of the light fraction cutting tower in the step (2) enters the lower part of the extracting desulfurization tower; and the desulfurization solvent is injected from the top of the extracting desulfurization tower.

The operation conditions of the extracting desulfurization tower are that: the temperature at the top of the tower is 110-120° C., the temperature at the bottom of the tower is 85-95° C.; the pressure (absolute pressure) at the top of the tower is 0.5-0.6 MPa; and the feed ratio of the desulfurization solvent to the middle gasoline is controlled to be 3.0.

The middle gasoline after being desulfurized is sent out from the top of the extracting desulfurization tower, washed with water for recycling the solvent, and then sent to the gasoline pool as a blending component; and the desulfurization solvent concentrated with small molecular iso-olefins, cycloolefins, aromatic hydrocarbons and sulfides is sent into the deoiling tower from the bottom of the extracting desulfurization tower.

(5) In the deoiling tower, the pressure (absolute pressure) at the top of the tower is controlled to be 0.015-0.02 MPa, and the temperature at the bottom of the tower is controlled to be 130-135° C.; the desulfurization solvent is purified by vacuuming distillation and stripping distillation; the sulfur-rich oil is distilled off at the top of the deoiling tower; and the extracted and deoiled desulfurization solvent at the bottom of the deoiling tower is returned into the top of the extracting desulfurization tower described in the step (4) for recycling use.

(6) The sulfur-rich oil distilled from the deoiling tower in the step (5) together with the heavy gasoline discharged from the bottom of the middle fraction cutting tower in the step (3) are sent to the hydrogenation apparatus for performing the highly active hydrogenation, in order to make the olefin therein be saturated, and to remove the sulfur to 10 ppm or less, then obtain the desulfurized and olefin-reduced fraction.

(7) The full range gasoline with a sulfur-content of less than 10 ppm and an olefin content of less than 22% is prepared and obtained by the desulfurized and olefin-reduced fraction obtained in the hydrogenation apparatus in the step (6) together with the middle gasoline obtained at the top of the extracting desulfurization tower in the step (4).

Example 2

A method for desulfurizing catalytic gasoline with a function of selectively removing olefins, the process flow of which is shown as the FIG. 1, specifically comprises the following steps:

(1) Performing the pre-hydrotreatment on the catalytic gasoline: the diene is hydroconverted, and at the same time, the small molecular sulfur is converted to the macromolecule sulfur, so that the sulfur in the light gasoline enters the heavier fraction.

(2) The pre-hydrotreated catalytic gasoline in the step (1) enters the light fraction cutting tower, the light gasoline mainly composed of the C5 fraction is cut at a cutting point of 50° C., the light gasoline is discharged from the top of the light fraction cutting tower, and the residual fraction is discharged from the bottom of the light fraction cutting tower and enters the middle fraction cutting tower.

(3) The middle gasoline mainly composed of C6-C9 fractions is cut at a cutting point of 160° C. in the middle fraction cutting tower, the middle gasoline is discharged from the top of the middle fraction cutting tower, and the heavy gasoline is discharged from the bottom of the middle fraction cutting tower.

(4) The middle gasoline discharged from the top of the middle fraction cutting tower in the step (3) enters the middle part of the extracting desulfurization tower, 80% of the light gasoline discharged from the top of the light fraction cutting tower in the step (2) enters the lower part of the extracting desulfurization tower; and the desulfurization solvent is injected from the top of the extracting desulfurization tower.

The operation conditions of the extracting desulfurization tower are that: the temperature at the top of the tower is 145-150° C., the temperature at the bottom of the tower is 100-120° C.; the pressure (absolute pressure) at the top of the tower is 0.5-0.7 MPa; the feed ratio of the desulfurization solvent to the middle gasoline is controlled to be 3.0; and the feed ratio of the light gasoline to the middle gasoline is controlled to be 0.3.

The middle gasoline after being desulfurized is sent out from the top of the extracting desulfurization tower, washed with water for recycling the solvent, and then sent to the gasoline pool as a blending component; and the desulfurization solvent concentrated with small molecular iso-olefins, cycloolefins, aromatic hydrocarbons and sulfides is sent into the deoiling tower from the bottom of the extracting desulfurization tower.

(5) In the deoiling tower, the pressure (absolute pressure) at the top of the tower is controlled to be 0.045-0.05 MPa, and the temperature at the bottom of the tower is controlled to be 170-135° C.; the desulfurization solvent is purified by vacuuming distillation and stripping distillation; the sulfur-rich oil is distilled off at the top of the deoiling tower; and the extracted and deoiled desulfurization solvent at the bottom of the deoiling tower is returned into the top of the extracting desulfurization tower described in the step (4) for recycling use.

(6) The sulfur-rich oil distilled from the deoiling tower in the step (5) together with the heavy gasoline discharged from the bottom of the middle fraction cutting tower in the step (3) are sent to the hydrogenation apparatus for performing the highly active hydrogenation, in order to make the olefin therein be saturated, and to remove the sulfur to 10 ppm or less, and obtain the desulfurized and olefin-reduced fraction.

(7) The full range gasoline with a sulfur-content of less than 10 ppm and an olefin content of less than 22% is prepared and obtained by the desulfurized and olefin-reduced fraction obtained in the hydrogenation apparatus in the step (6) together with the light gasoline obtained at the top of the light fraction cutting tower in the step (2) and the middle gasoline obtained at the top of the extracting desulfurization tower in the step (4).

Example 3

A method for desulfurizing catalytic gasoline with a function of selectively removing olefins, the process flow of which is shown as the FIG. 1, specifically comprises the following steps:

(1) Performing the pre-hydrotreatment on the catalytic gasoline: the diene is hydroconverted, and at the same time, the small molecular sulfur is converted to the macromolecule sulfur, so that the sulfur in the light gasoline enters the heavier fraction.

(2) The pre-hydrotreated catalytic gasoline in the step (1) enters the light fraction cutting tower, the light gasoline mainly composed of the C5 fraction is cut at a cutting point of 30° C., the light gasoline is discharged from the top of the light fraction cutting tower, and the residual fraction is discharged from the bottom of the light fraction cutting tower and enters the middle fraction cutting tower.

(3) The middle gasoline mainly composed of C6-C8 fractions is cut at a cutting point of 130° C. in the middle fraction cutting tower, the middle gasoline is discharged from the top of the middle fraction cutting tower, and the heavy gasoline is discharged from the bottom of the middle fraction cutting tower.

(4) The middle gasoline discharged from the top of the middle fraction cutting tower in the step (3) enters the middle part of the extracting desulfurization tower, the light gasoline discharged from the top of the light fraction cutting tower in the step (2) enters the lower part of the extracting desulfurization tower; and the desulfurization solvent is injected from the top of the extracting desulfurization tower.

The operation conditions of the extracting desulfurization tower are that: the temperature at the top of the tower is 130-135° C., the temperature at the bottom of the tower is 90-100° C.; the pressure (absolute pressure) at the top of the tower is 0.4-0.6 MPa; and the feed ratio of the desulfurization solvent to the middle gasoline is controlled to be 5.0.

The middle gasoline after being desulfurized is sent out from the top of the extracting desulfurization tower, washed with water for recycling the solvent, and then sent to the gasoline pool as a blending component; and the desulfurization solvent concentrated with small molecular iso-olefins, cycloolefins, aromatic hydrocarbons and sulfides is sent into the deoiling tower from the bottom of the extracting desulfurization tower.

(5) In the deoiling tower, the pressure (absolute pressure) at the top of the tower is controlled to be 0.06-0.07 MPa, and the temperature at the bottom of the tower is controlled to be 150-165° C.; the desulfurization solvent is purified by vacuuming distillation and stripping distillation; the sulfur-rich oil is distilled off at the top of the deoiling tower; and the extracted and deoiled desulfurization solvent at the bottom of the deoiling tower is returned into the top of the extracting desulfurization tower described in the step (4) for recycling use.

(6) The sulfur-rich oil distilled from the deoiling tower in the step (5) together with the heavy gasoline discharged from the bottom of the middle fraction cutting tower in the step (3) are sent to the hydrogenation apparatus for performing the highly active hydrogenation, in order to make the olefin therein be saturated, and to remove the sulfur to 10 ppm or less, and obtain the desulfurized and olefin-reduced fraction.

(7) The full range gasoline with a sulfur-content of less than 10 ppm and an olefin content of less than 22% is prepared and obtained by the desulfurized and olefin-reduced fraction obtained in the hydrogenation apparatus in the step (6) together with the light gasoline obtained at the top of the light fraction cutting tower in the step (2) and the middle gasoline obtained at the top of the extracting desulfurization tower in the step (4).

The invention claimed is:

1. A catalytic gasoline desulfurization method that is also capable of selective removal of an olefin, comprising:

1) pre-hydrotreating a catalytic gasoline, and then cutting the catalytic gasoline into a light fraction having a sulfur content of less than 10 ppm and mainly containing C5 fractions, a middle fraction mainly containing C6-C9 fractions, and a heavy fraction;

2) performing a liquid-liquid extraction desulfurization treatment on the middle fraction obtained in the step 1) using a desulfurization solvent to produce a sulfur-poor oil with a sulfur content of less than 10 ppm and a sulfur-rich oil, wherein the sulfur-rich oil is also called a rich solvent and contains macromolecular acyclic olefins, aromatic hydrocarbons, and sulfides dissolved in the desulfurization solvent;

3) performing a back-extraction of the rich solvent obtained in the step 2) using part of or all the light fraction obtained in the step 1) to obtain a back-extracted rich solvent containing C5 iso-olefins, cycloolefins, aromatic hydrocarbon, and sulfides; and 4) separating a second sulfur-rich oil from the back-extracted rich solvent in the step 3), then performing hydrogenation, olefin-reduction and desulfurization treatment on the heavy fraction obtained in step 1) together with the second sulfur-rich oil to make olefin contained in the heavy fraction and the second sulfur-rich oil be as saturated as possible to obtain a product having a sulfur content of less than 10 ppm; and preparing a full range gasoline with the product together with the remainder of the light fraction obtained in the step 1) and the sulfur-poor oil obtained in the step 2).

2. The method according to claim 1 wherein, the pre-hydrotreating described in the step 1) is a liquid phase hydrogenation using a cobalt molybdenum catalyst at an operating pressure of 1.0-3.0 MPa, a temperature of 100-200° C., and a hydrogen-oil ratio of 3-10, and a space velocity of 1-3 $h^{-1}$.

3. The method according to claim 1, wherein said light fraction is obtained at a cutting point of 30-50° C., and said middle fraction is obtained at a cutting point of 130-160° C.

4. The method according to claim 1, wherein the liquid-liquid extraction desulfurization treatment on the middle fraction by using the desulfurization solvent in the step 2) is performed in an extracting desulfurization tower; said middle fraction is fed from a middle of the extracting desulfurization tower, said desulfurization solvent is injected from a top of the extracting desulfurization tower; a temperature at the top of the extracting desulfurization tower is controlled to 85-150° C., a temperature at a bottom of the extracting desulfurization tower is controlled to 70-120° C., a pressure (absolute pressure) at the top of the extracting desulfurization tower is controlled to 0.2-0.7 MPa, a feed ratio of the desulfurization solvent to the middle fraction is controlled to 1.0-5.0, said middle fraction is in multi-stage-countercurrent contact with the desulfurization solvent in an upper part of the tower, and the sulfur-poor oil having a sulfur-content of less than 10 ppm obtained at the top of the extracting desulfurization tower is washed with water for recovering the desulfurization solvent and then sent to a gasoline pool as a blending component.

5. The method according to claim 4, wherein the back-extraction in the step 3) is carried out in said extracting desulfurization tower, said light fraction is fed from a lower part of the extracting desulfurization tower, and a feed ratio of the light fraction to the middle fraction is controlled to 0.1-0.5.

6. The method according to claim 4, wherein separating the second sulfur-rich oil from the rich solvent in the step 4) is carried out in a deoiling tower, a pressure at a top of the deoiling tower is controlled to 0.015 to 0.07 MPa, a temperature at a bottom of the deoiling tower is controlled to 130-175° C.; and after vacuuming distillation and stripping distillation, the second sulfur-rich oil is distilled from the top of the deoiling tower and sent to a hydrogenation apparatus for desulfurizing and reducing olefin, and the desulfurization solvent is extracted from the bottom of the deoiling tower and then returned into the extracting desulfurization tower from the top thereof for recycling.

7. The method according to claim 1, wherein the hydrogenation, olefin-reduction, and desulfurization treatment in the step 4) is performed with a catalyst at a temperature of 240-320° C., a pressure of 1.0-3.0 MPa, a volume ratio of hydrogen to the sulfur-rich oil of 200-500, and a space velocity of 1-4 $h^{-1}$, the catalyst includes an active component and a carrier, the active component includes at least one selected from the group consisting of nickel, molybdenum, tungsten, and an ion thereof, and the carrier includes an activated alumina.

8. A catalytic gasoline desulfurization method, comprising:

(1) pre-hydrotreating a catalytic gasoline via a liquid phase hydrogenation using cobalt molybdenum as an active catalyst at an operating pressure of 1.0-3.0 MPa, a temperature of 100-200° C., a hydrogen-oil volume ratio of 3-10, and a space velocity of 1-3 $h^{-1}$ to obtain a pre-hydrotreated catalytic gasoline;

(2) passing the pre-hydrotreated catalytic gasoline into a fractionation tower, which is a light-fraction-cutting-tower, for cutting the pre-hydrotreated catalytic gasoline into a light gasoline and a residue fraction at a cutting point of 40° C., wherein the light gasoline mainly contains C5 fractions, the light gasoline is discharged from a top of the light fraction cutting tower, while the residual fraction is discharged from a bottom of the light fraction cutting tower;

(3) entering the residue fraction into a middle-fraction-cutting tower for cutting the residue fraction into a middle gasoline and a heavy gasoline at a cutting point of 150° C., wherein the middle gasoline mainly contains C6-C9 fractions, the middle gasoline is discharged from a top of the middle-fraction-cutting tower, and the heavy gasoline is discharged from a bottom of the middle-fraction-cutting tower;

(4) entering the middle gasoline into a middle part of an extracting desulfurization tower, and entering all or a part of the light gasoline discharged from the top of the light-fraction-cutting-tower in the step (2) into a lower part of the extracting desulfurization tower, and injecting a desulfurization solvent from a top of the extracting desulfurization tower, wherein the extracting desulfurization tower has a temperature of 85-150° C. at the top thereof, a temperature of 70-120° C. at a bottom thereof, a pressure of 0.2-0.7 MPa at the top thereof, a feed ratio of the desulfurization solvent to the middle gasoline is controlled to 1.0-5.0, a feed ratio of the light gasoline to the middle gasoline is controlled to 0.1-0.5, the middle gasoline after being desulfurized is discharged from the top of the extracting desulfurization tower, washed with water for recycling the desulfurization solvent to obtain a desulfurized middle gasoline, and the desulfurized middle gasoline then enters a gasoline pool as a blending component;

(5) entering the desulfurization solvent containing small molecular iso-olefins, cycloolefins, aromatic hydrocarbons and sulfides into a deoiling tower from the bottom of the extracting desulfurization tower, wherein the deoiling tower has a pressure of 0.015-0.07 MPa at a top thereof and a temperature of 130-175° C. at a bottom thereof, the desulfurization solvent is purified by vacuuming distillation and stripping distillation, a sulfur-rich oil is distilled off from a location at the top of the extracting desulfurization tower, and an extracted and deoiled desulfurization solvent at the bottom of the deoiling tower is returned into the top of the extracting desulfurization tower for recycling;

(6) entering the sulfur-rich oil distilled from the deoiling tower in the step (5) and the heavy gasoline discharged from the bottom of the middle-fraction-cutting tower in the step (3) into an hydrogenation apparatus for performing hydrogenation to saturate an olefin contained therein to to obtain a desulfurized and olefin-reduced fraction having a sulfur content of 10 ppm or less;

(7) obtaining a full range gasoline having a sulfur-content of less than 10 ppm and an olefin content of less than 22 vol % with the desulfurized and olefin-reduced fraction together with the light gasoline in the step (2) and the desulfurized middle gasoline.

9. The method according to claim 1, wherein the back-extraction replaces a macromolecular acyclic olefin in the sulfur-rich oil with a C5 olefin in the light fraction.

* * * * *